US010369797B2

(12) United States Patent
Genta et al.

(10) Patent No.: US 10,369,797 B2
(45) Date of Patent: Aug. 6, 2019

(54) INKJET PRINTING APPARATUS AND PRELIMINARY DISCHARGING METHOD

(71) Applicant: CANON KABUSHIKI KAISHA, Tokyo (JP)

(72) Inventors: Shin Genta, Yokohama (JP); Masaya Uetsuki, Yokohama (JP); Toshimitsu Danzuka, Tokyo (JP); Kazuo Suzuki, Yokohama (JP); Yoshinori Nakagawa, Kawasaki (JP); Masataka Kato, Yokohama (JP); Tsuyoshi Ibe, Yokohama (JP); Tomoki Yamamuro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/826,896

(22) Filed: Nov. 30, 2017

(65) Prior Publication Data

US 2018/0079218 A1 Mar. 22, 2018

Related U.S. Application Data

(62) Division of application No. 15/164,243, filed on May 25, 2016, now Pat. No. 9,862,195.

(30) Foreign Application Priority Data

May 27, 2015 (JP) ..... 2015-107490

(51) Int. Cl.
*B41J 2/165* (2006.01)

(52) U.S. Cl.
CPC ..... *B41J 2/16535* (2013.01); *B41J 2/16508* (2013.01); *B41J 2/16526* (2013.01); *B41J 2002/16573* (2013.01)

(58) Field of Classification Search
CPC .. B41J 2/16535; B41J 2/16508; B41J 2/1652; B41J 2002/16573
See application file for complete search history.

(56) References Cited

U.S. PATENT DOCUMENTS 5,701,146 A 12/1997 Akiyama et al.
6,984,018 B2 * 1/2006 Uetsuki ..... B41J 2/16517 347/23

(Continued)

FOREIGN PATENT DOCUMENTS

JP H08-39825 A 2/1996
JP 2720060 11/1997

(Continued)

OTHER PUBLICATIONS

Japanese Office Action issued in corresponding Japanese Application No. 2015/107490 dated Oct. 2, 2018.

*Primary Examiner* — Sharon A. Polk
(74) *Attorney, Agent, or Firm* — Venable LLP

(57) ABSTRACT

Provided is an inkjet printing apparatus capable of performing preliminary discharge without the influence of mist while suppressing degradation in throughput regardless of a preliminary discharge time. Specifically, an inkjet printing apparatus that performs a wiping operation on a nozzle arrangement surface provided with nozzles discharging an ink in a print head includes a wiping determination unit that determines whether to perform the wiping operation before preliminary discharge based on the amount of the preliminary discharge to be performed.

17 Claims, 14 Drawing Sheets

| THRESHOLD VALUE | A | B |
|---|---|---|
| NUMBER OF TIMES OF PRELIMINARY DISCHARGE | 1,969 TIMES | 33 TIMES |

(56) References Cited

U.S. PATENT DOCUMENTS

| | | | | |
|---|---|---|---|---|
| 7,527,348 | B2 | 5/2009 | Uetsuki et al. | |
| 2004/0041875 | A1* | 3/2004 | Yazawa ..... | B41J 2/16526<br>347/23 |
| 2005/0270323 | A1 | 12/2005 | Oshio et al. | |
| 2010/0302297 | A1 | 12/2010 | Suzuki et al. | |

FOREIGN PATENT DOCUMENTS

| | | | |
|---|---|---|---|
| JP | 2004090233 | A | 3/2004 |
| JP | 2010280081 | A | 12/2010 |

* cited by examiner

FIG.14A

| THRESHOLD VALUE | A | B |
|---|---|---|
| NUMBER OF TIMES OF PRELIMINARY DISCHARGE | 1,969 TIMES | 33 TIMES |

FIG.14B

| PRELIMINARY DISCHARGE CONDITION | |
|---|---|
| NUMBER OF DISCHARGES PER ONE-TIME PRELIMINARY DISCHARGE FOR EACH COLOR | 960 DISCHARGES |
| PRELIMINARY DISCHARGE FREQUENCY | 10.5kHz |

INKJET PRINTING APPARATUS AND PRELIMINARY DISCHARGING METHOD

This application is a divisional of U.S. patent application Ser. No. 15/164,243, filed May 25, 2016, the entirety of which is incorporated herein by reference.

BACKGROUND OF THE INVENTION

Field of the Invention

The present invention relates to an inkjet printing apparatus and a preliminary discharging method, and particularly, to control of preliminary discharge for keeping a satisfactory discharge state of a print head, such as control of the number of times of the discharge during preliminary discharge.

Description of the Related Art

As an example of preliminary discharge, there is known an aging process which is performed in order to avoid a change in density among nozzles caused by the influence of a burnt deposit occurring inside a nozzle of a print head. As for the aging process disclosed in Japanese Patent Laid-Open No. H08-039825(1996), the cumulative number of times of the discharge for each nozzle is obtained and the number of times of the discharge for each nozzle during preliminary discharge is set according to the cumulative number of times of the discharge. More specifically, the number of times of the discharge is set so that the number of times of the discharge during the preliminary discharge is greater in the nozzle of which the cumulative number of times of the discharge is smaller. Thereby, it is possible to suppress an increase in the amount of the ink consumed in the entire print head during the aging process.

However, in Japanese Patent Laid-Open No. H08-039825 (1996), the number of times of the discharge for the aging process is set for each nozzle based on the cumulative number of times of the discharge of each individual nozzle. For this reason, the number of times of the discharge during the aging process, that is, the time necessary for the preliminary discharge varies among the nozzles. Thus, there is a case in which the time necessary for the preliminary discharge may be comparatively long in a particular nozzle. In such a case, in the nozzle of which the discharge time is comparatively short, for example, ink mist caused by a printing operation before the preliminary discharge is thickly attached to the nozzle during the preliminary discharge. As a result, there is a concern that the subsequent discharge may be influenced. On the contrary, a method may be supposed which removes the mist by wiping a surface where the nozzles are arranged (a nozzle arrangement surface) in the print head before the preliminary discharge. However, when the wiping operation is performed with no exception before the preliminary discharge, there is also a concern that the throughput of the apparatus may be degraded.

Depending on the time taken for the preliminary discharge, the amount of the ink mist generated by the preliminary discharge may eventually influence the other parts of the printing apparatus. On the contrary, the preliminary discharge can be performed while the nozzle arrangement surface of the print head is covered by a cap. However, in such a configuration, since the print head is covered by the cap even when the amount of the generated ink mist does not influence the other parts, the throughput is decreased due to the capping operation.

SUMMARY OF THE INVENTION

An object of the invention is to provide an inkjet printing apparatus and a preliminary discharging method capable of performing preliminary discharge without the influence of mist, while suppressing decrease in throughput regardless of a preliminary discharge time.

In a first aspect of the present invention there is provided an inkjet printing apparatus comprising: a print head having a nozzle arrangement surface on which a nozzle for discharging ink is provided; a preliminary discharge control unit configured to perform a preliminary discharge operation in which ink discharge that does not contribute printing is performed; a wiping unit configured to perform a wiping operation for the nozzle arrangement surface; and a wiping control unit configured to control the wiping unit to perform the wiping operation before the preliminary discharge control unit performs the preliminary discharge operation, wherein the wiping control unit controls the wiping unit not to perform the wiping operation if a preliminary discharge amount in the preliminary discharge operation is smaller than a first threshold value.

In a second aspect of the present invention there is provided an inkjet printing apparatus comprising: a print head having a nozzle arrangement surface on which a nozzle for discharging ink is provided; a cap unit configured to cover the nozzle arrangement surface; and a preliminary discharge control unit configured to perform a preliminary discharge operation in which ink discharge that does not contribute printing is performed, wherein the preliminary discharge control unit performs the preliminary discharge operation with the nozzle arrangement surface covered by the cap unit if a preliminary discharge amount in the preliminary discharge operation is greater than a second threshold value and performs the preliminary discharge operation without the nozzle arrangement surface covered by the cap unit if the preliminary discharge amount is smaller than the second threshold value.

In a third aspect of the present invention there is provided a control method for an inkjet printing apparatus including a print head having a nozzle arrangement surface on which a nozzle for discharging ink is provided, a preliminary discharge control unit configured to perform a preliminary discharge operation in which ink discharge that does not contribute printing is performed, and a wiping unit configured to perform a wiping operation for the nozzle arrangement surface, the control method comprising: a wiping step of performing the wiping operation before the preliminary discharge control unit performs the preliminary discharge operation, wherein the wiping step does not perform the wiping operation if a preliminary discharge amount in the preliminary discharge operation is smaller than a first threshold value.

In a fourth aspect of the present invention there is provided a control method for an inkjet printing apparatus including a print head having a nozzle arrangement surface on which a nozzle for discharging ink is provided, and a cap unit configured to cover the nozzle arrangement surface, the control method comprising: a preliminary discharge step of performing a preliminary discharge operation in which ink discharge that does not contribute printing is performed, wherein the preliminary discharge step performs the preliminary discharge operation with the nozzle arrangement surface covered by the cap unit if a preliminary discharge amount in the preliminary discharge operation is greater than a second threshold value and performs the preliminary discharge operation without the nozzle arrangement surface covered by the cap unit if the preliminary discharge amount is smaller than the second threshold value.

According to the above-described configuration, it is possible to perform the preliminary discharge without the influence of mist while suppressing degradation in throughput regardless of the preliminary discharge time.

Further features of the present invention will become apparent from the following description of exemplary embodiments (with reference to the attached drawings).

BRIEF DESCRIPTION OF THE DRAWINGS

FIG. 14A is a table listing threshold values used to determine whether to perform a cleaning operation before preliminary discharge, and FIG. 14B is a table listing discharge conditions used to determine whether to perform a capping operation during the preliminary discharge according to the embodiment of the invention.

DESCRIPTION OF THE EMBODIMENTS

Hereinafter, embodiments of the present invention will be described in detail with reference to the accompanying drawings.

Figure 1:
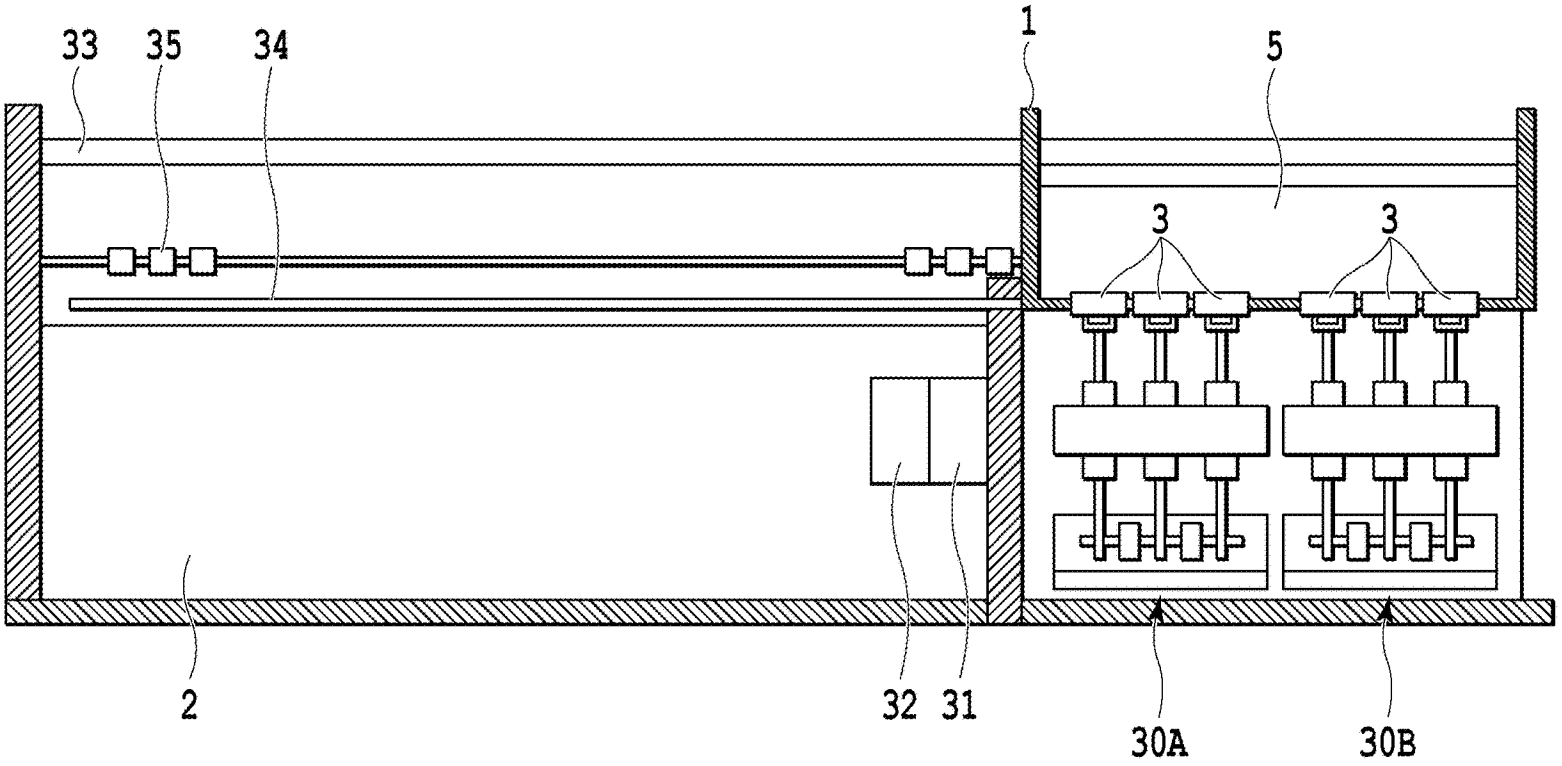
FIG. 1 is a schematic front view illustrating an inkjet printing apparatus according to an embodiment of the invention.

FIG. 1 is a schematic front view illustrating an inkjet printing apparatus according to an embodiment of the invention. In FIG. 1, reference numeral 2 denotes a main body of an inkjet printing apparatus including a sheet conveying unit. In the embodiment, the printing apparatus is used to print an image on a comparatively large sized print medium. A carriage 1 mounts a print head 5 having twelve discharge portions (nozzle arrays) provided so as to correspond to twelve colors of ink. The carriage 1 is able to move in a reciprocating manner along a guide shaft 33 by a driving force transmitted through a belt 34. Thereby, the print head 5 is able to scan a print medium to print an image on the print medium while an ink is discharged thereonto during the scanning operation. The ink used in the embodiment corresponds to the ink of twelve colors including cyan, photo cyan, magenta, photo magenta, yellow, blue, red, photo black, matt black, gray, and photo gray, as well as a clear ink not including a color material.

Each of recovery mechanisms 30A and 30B includes a cap 3 and the like and keeps or recovers the satisfactory ink discharge state of each discharge portion of the print head 5. When the nozzle arrangement surface of the print head is covered (capped) by the cap 3, the discharge portion or the print head 5 is protected when the print head is not used. Further, when a pump (not illustrated) is driven in the capping state so as to apply a suction force to the discharge portion, an operation (a suction recovery operation) of forcedly discharging the ink can be performed. Further, as will be described later, preliminary discharge of discharging the ink into the cap can be performed while the cap 3 faces the discharge portion. Each cap 3 can be used to cover two adjacent nozzle arrays. An ink storage box 31 stores the ink discharged by the preliminary discharge different from the preliminary discharge into the cap. Further, a wiping mechanism 32 includes a wiper and is used to wipe the nozzle arrangement surface of the print head 5.

In the above-described configuration, the carriage 1 is controlled so that the carriage moves in a direction following the guide shaft 33 (a first direction) with respect to a print medium conveyed to a printing area. Accordingly, the print head 5 is able to print an image including characters or drawings corresponding to each band (an area in which an image can be printed by a one-time printing operation of the print head 5) in a manner such that the print head scans the print medium and the ink is discharged from the discharge portion of each color of the ink during the scanning operation. Then, when the printing operation corresponding to each band ends, the print medium is conveyed by a conveying unit (not illustrated) by a predetermined distance (a distance corresponding to the width of each band or a printing width printed by a predetermined number of nozzles) in a direction intersecting the movement direction of the carriage 1 (a direction as a second direction perpendicular to the drawing paper of FIG. 1).

An encoder 35 for detecting the movement position of the carriage 1 is disposed in the movement path of the carriage 1, and the position of the carriage can be detected based on a signal generated when an encoder sensor mounted on the carriage 1 detects the encoder. Further, the movement of the carriage 1 to the home position is controlled based on the detection of the position of the encoder. The recovery mechanisms 30A and 30B and the wiping mechanism 32 are disposed in the vicinity of the home position.

Figure 2:
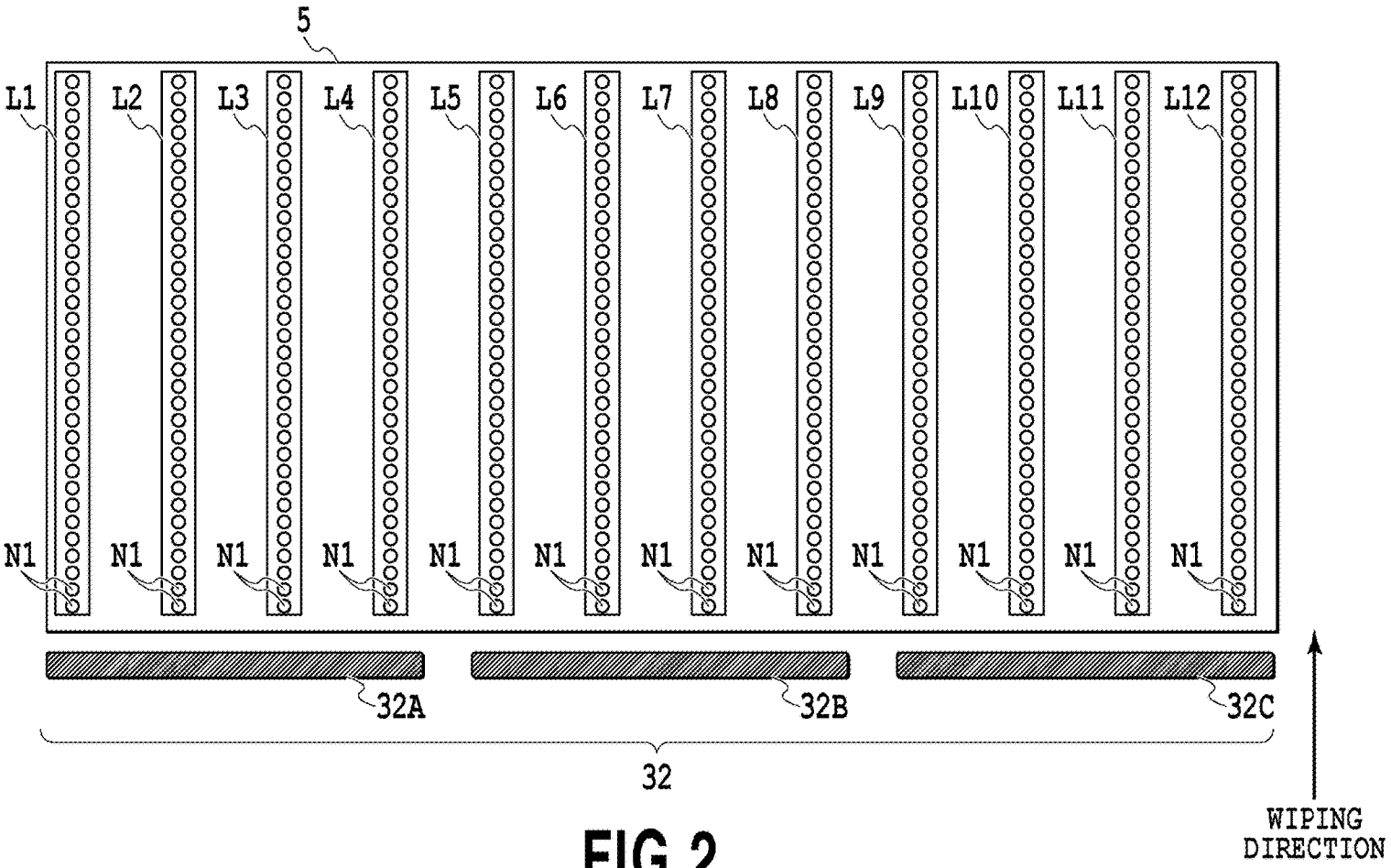
FIG. 2 is a schematic diagram illustrating the configurations of a print head 5 and a wiping mechanism 32 illustrated in FIG. 1 and a relation therebetween.

FIG. 2 is a schematic diagram illustrating the configurations of the print head 5 and the wiping mechanism 32 illustrated in FIG. 1 and a relation therebetween. As illustrated in FIG. 2, the print head 5 of the embodiment includes twelve nozzle arrays L1 to L12 corresponding to twelve types of ink. Each of the nozzle arrays are formed by disposing one thousand fifty-six nozzles N1. In addition, in FIGS. 5A to 5C, each nozzle array is shown as arranging thirty-two nozzles in order to simplify the drawings. In each nozzle, an electro-thermal conversion element is disposed in an ink liquid path. Thereby, the ink is locally heated by the heat generated by the electro-thermal conversion element for causing film boiling and hence the ink can be discharged by the pressure thereof.

The wiping mechanism 32 of the embodiment includes a wiper 32A which is able to wipe the nozzle arrangement surfaces of the nozzle arrays L1 to L4, a wiper 32B which is able to wipe the nozzle arrangement surfaces of the nozzle arrays L5 to L8, and a wiper 32C which is able to wipe the nozzle arrangement surfaces of the nozzle arrays L9 to L12. Then, a wiping operation can be performed in a manner such that the print head 5 is set to a position corresponding to the wiping mechanism 32 and the wipers 32A, 32B, and 32C are moved in a direction indicated by the arrow of FIG. 2.

Figure 3:
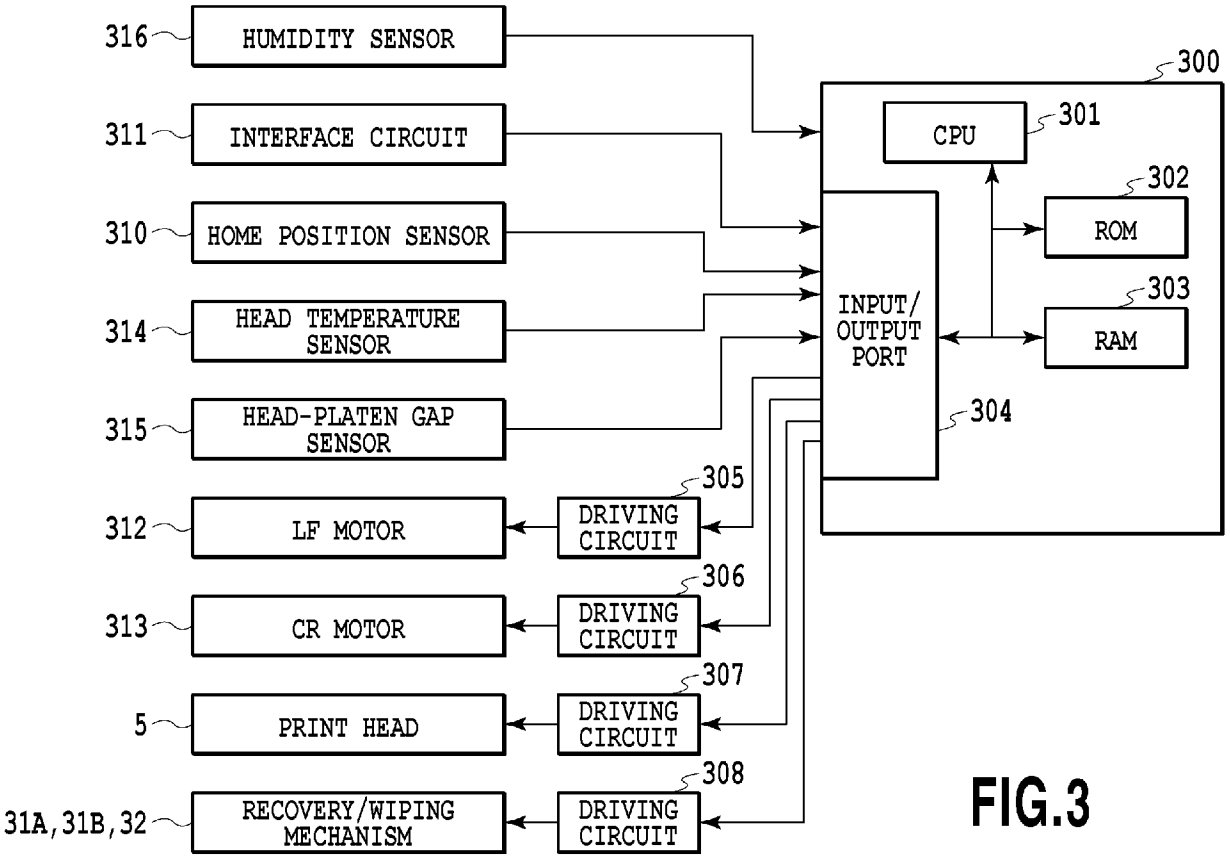
FIG. 3 is a block diagram illustrating the control configuration of the printing apparatus illustrated in FIG. 1.

FIG. 3 is a block diagram illustrating the control configuration of the printing apparatus illustrated in FIG. 1. In FIG. 3, a main control unit 300 includes a CPU 301, a ROM 302, a RANI 303, and an input/output port 304 and controls the components of the printing apparatus of the embodiment. The CPU 301 performs a process necessary for a calculation, a control, a determination, and a setting, including processes shown in FIGS. 9, 10, and 13. The ROM 302 stores a control program to be performed by the CPU 301 and the other fixed data. Specifically, a table, to be described later in FIGS. 14A and 14B, can be stored. The RAM 303 includes a buffer area of data to be printed, or an area used as a work area, during a process performed by the CPU 301. Specifically, an area used as a counter for counting the printing amount (the number of printed sheets of the printing media or the number of times of discharging the ink during the printing operation) in the process to be described later can be included.

The input/output port 304 is connected to a driving circuit 305 of a conveying motor (LF motor) 312, constituting a driving source of a conveying system, and a driving circuit 306 of a motor (a CR motor) 313, constituting a driving source moving the carriage 1. Further, the input/output port 304 is connected to a driving circuit 307 for driving the nozzle of each discharge portion of the print head 5. In addition, the input/output port 304 is connected to a driving circuit 308 for driving the recovery mechanisms 30A and 30B and the wiping mechanism 32. Further, the input/output port 304 is connected to a home position sensor 310, a head temperature sensor 314, a gap sensor 315, and an interface circuit 311. The home position sensor 310 is a sensor for detecting the position as the reference of the movement control of the carriage 1 or the print head 5. Further, the position of the print head 5 is set with respect to the recovery mechanisms 30A and 30B and the wiping mechanism 32 based on the detection output of the home position sensor 310. The gap sensor 315 is used to detect a distance with respect to the print medium or platen. The interface circuit 311 is used to send and receive necessary information to and from an external device (the computer can be an image scanner, a digital camera, or other devices) constituting a supply source of a data to be printed. Reference numeral 316 indicates a humidity sensor, provided at an appropriate position, and which is used to detect the humidity as the usage environment of the apparatus.

The printing apparatus according to the embodiment of the present invention performs a plurality of printing modes and determines whether to perform preliminary discharge in accordance with the performed printing mode. Hereinafter, the plurality of printing modes of the embodiment will be described.

(First Multi-Path Printing Operation (First Printing Mode))

Figure 4:
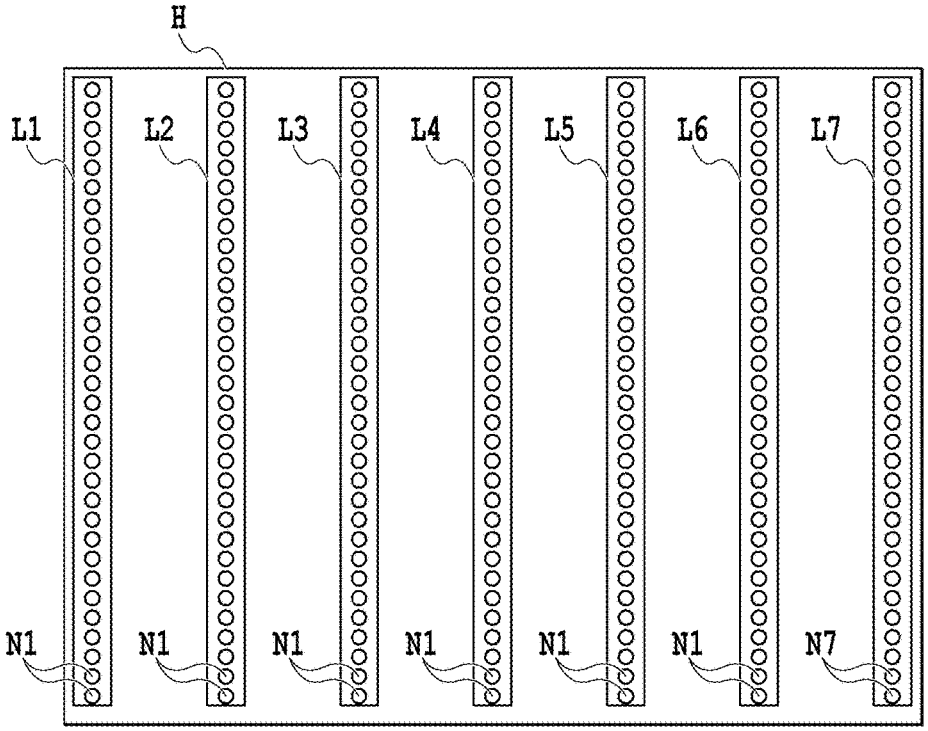
FIG. 4 is a diagram more simply illustrating the arrangement of nozzles of the print head illustrated in FIG. 2.

FIG. 4 is a diagram more simply illustrating the arrangement of the nozzles of the print head illustrated in FIG. 2, and is used to describe the printing modes to be described later. That is, in the description of the printing modes below, a case will be described in which each nozzle array of the print head includes thirty-two nozzles. Further, seven nozzle arrays L1 to L7, including the nozzle arrays L1 to L6 discharging six types of color ink (cyan, magenta, yellow, blue, red, and black), respectively, and the nozzle array L7 discharging the clear ink not including a color material, are arranged.

Figures 5A, 5B, 5C:
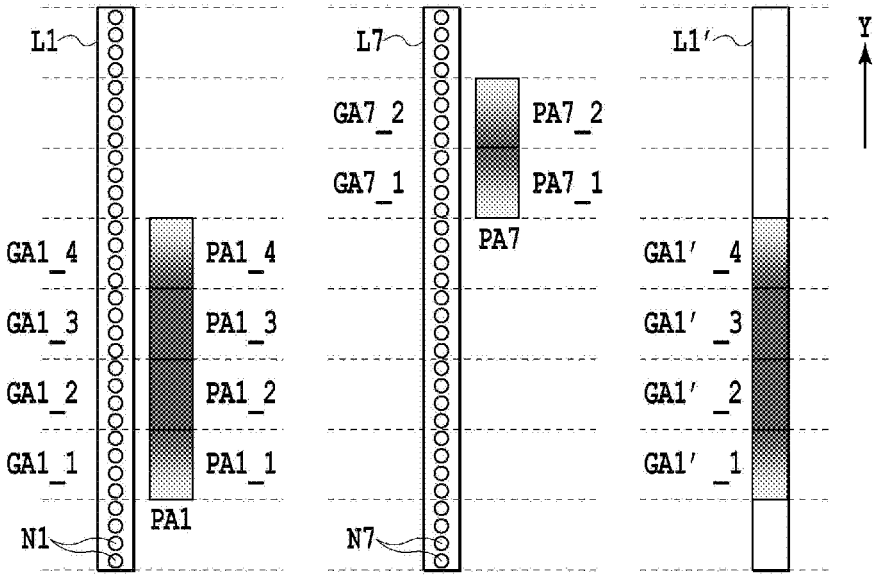
FIGS. 5A to 5C are schematic diagrams illustrating nozzle arrays and mask patterns used to describe a first multi-path printing operation as a first printing mode according to the embodiment of the invention.

FIGS. 5A to 5C are schematic diagrams illustrating the nozzle arrays and the mask patterns for describing a first multi-path printing operation as the first printing mode among the plurality of (three) printing modes of the embodiment. FIG. 5A illustrates the nozzle array (L1) of the color ink described in FIG. 4 and the mask pattern corresponding to the nozzle and FIG. 5B illustrates the nozzle array of the clear ink and the mask pattern. Further, FIG. 5C illustrates the attachment state of a burnt deposit which is supposed to exist in the color ink nozzle array after the printing operation is performed by the color ink and the clear ink through the mask pattern.

In FIG. 5A, first to fourth divided nozzle groups GA1_1 to GA1_4 of the nozzle array L1 are used, and each nozzle group includes four nozzles N1. A mask pattern PA1 includes first to fourth mask patterns PA1_1 to PA1_4. The first to fourth mask patterns PA1_1 to PA1_4 respectively correspond to the first to fourth nozzle groups GA1_1 to GA1_4. The mask pattern PA1 is a so-called gradation mask in which the duty is higher as a color shown in FIG. 5A is darker and the duty is lower as the color is lighter. The mask patterns PA1$_{_1\ to\ PA1}$_4 have a complementary relation with respect to the duty and therefore these four mask patterns are used as overlapping one another to complete printing an image on the corresponding area. As apparent from the above description, four upstream nozzles and twelve downstream nozzles of thirty two nozzles of the nozzle array L1 in the print medium conveying direction are not used for the printing operation during the printing operation using the color ink.

In the case of the clear ink illustrated in FIG. 5B, first and second divided nozzle groups GA7_1 and GA7_2 are used in the nozzle array L7, including the nozzle N7, and each nozzle group includes four nozzles. Two mask patterns PA7_1 and PA7_2, as the first and second mask patterns corresponding to the nozzle groups, overlap each other to complete printing an image on the corresponding area. Thus, twenty upstream nozzles and four downstream nozzles of thirty two nozzles of the nozzle array L7 in the print medium conveying direction are not used for the printing operation during the printing operation using the clear ink illustrated in FIG. 5B.

According to the above-described multi-path printing control, an image can be completely printed on a unit area in a manner such that an image is printed on the same printing area (the unit area corresponding to the width of each nozzle group) of the print medium by four-time printing operations using the nozzle arrays of the color ink and an image is printed thereon by two-time printing operations using the nozzle arrays of the clear ink. That is, the clear ink can be applied to the image printed by the color ink through six-time printing operations in total.

FIG. 5C illustrates the state of a burnt deposit which is supposed to occur on a discharge heater inside each nozzle when the above described first multi-path printing operation (the first printing mode) is performed. Here, the burnt deposit degree is larger as the color shown in FIG. 5C is darker. More specifically, as illustrated in the mask pattern of FIG. 5A, it is estimated that the burnt deposit degree becomes larger when the discharge heater of the nozzle has a higher usage frequency (duty). As illustrated in FIG. 5C, in the nozzle array L1' after the printing operation, a burnt deposit occurs in the nozzle groups GA1'_1 to GA1'_4 in accordance with the duties of the nozzles. Particularly in the nozzle groups GA1'_2 and GA1'_3 having high duties, the burnt deposit degree is great. Meanwhile, since the nozzles in the white area other than the nozzle groups GA1'_1 to GA1'_4 are not used for the printing operation, the burnt deposit attachment amount does not change before and after the printing operation.

(Second Multi-Path Printing Operation (Second Printing Mode))

Figures 6A, 6B, 6C:
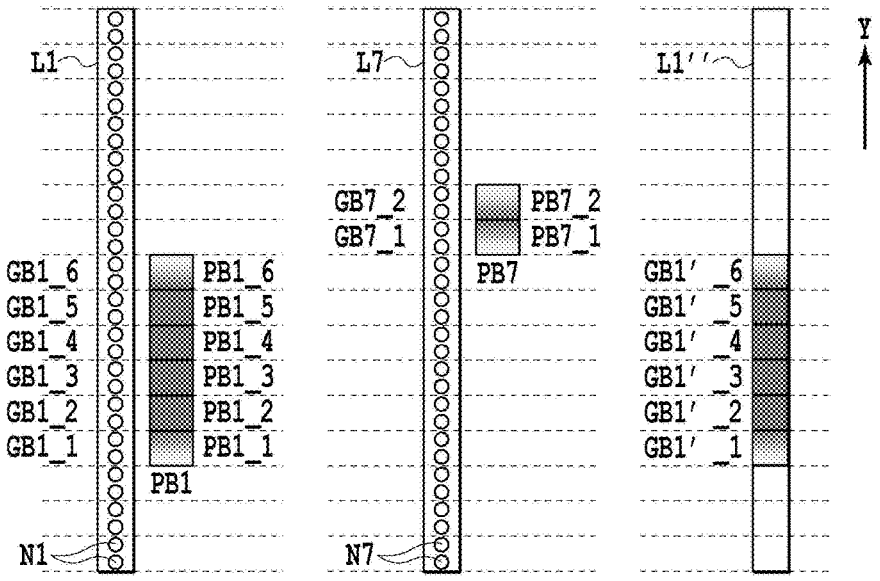
FIGS. 6A to 6C are schematic diagrams illustrating nozzle arrays and mask patterns used to describe a second multi-path printing operation as a second printing mode according to the same embodiment of the invention.

FIGS. 6A to 6C are schematic diagrams illustrating the nozzle arrays and the mask patterns for describing a second multi-path printing operation as the second printing mode among three printing modes of the embodiment, similar to FIGS. 5A to 5C which illustrate the nozzle arrays and the mask patterns for the first printing mode. The second printing mode is concerned with the multi-path printing operation similar to the first printing mode, but is different from the first printing mode as described below. Here, an image is printed on the unit area by six-time printing operations using the color ink and subsequent two-time printing operations using the clear ink. Thus, an image is completely printed on the unit area by eight-time printing operations in total.

As illustrated in FIG. 6A, first to sixth divided nozzle groups GB1_1 to GB1_6 are used in the nozzle array L1 of the color ink, and each nozzle group includes two nozzles N1. A mask pattern PB1 includes first to sixth mask patterns PB1_1 to PB1_6 so as to correspond to the used nozzle group. The first to sixth mask patterns PB1_1 to PB1_6 correspond to the gradation mask similar to the first printing mode. In this way, six upstream nozzles and fourteen downstream nozzles in the print medium conveying direction are not used for the printing operation during the printing operation using the color ink. Next, in the case of the clear ink illustrated in FIG. 6B, first and second divided nozzle groups GB7_1 and GB7_2 of the nozzle array L7 are used, and each nozzle group includes two nozzles. The first and second mask patterns PB7_1 and PB7_2 corresponding to these used nozzles overlap each other to complete printing an image of the unit area. That is, eighteen upstream nozzles and ten downstream nozzles in the print medium conveying direction are not used for the printing operation during the printing operation using the clear ink illustrated in FIG. 6B.

FIG. 6C illustrates the state of a burnt deposit which is supposed to occur on a discharge heater inside each nozzle when the second multi-path printing operation (the second printing mode) is performed. Here, the burnt deposit degree is larger as the color shown in FIG. 6C is darker. Similarly to the first printing mode illustrated in FIG. 5C, in the nozzle array L1' after the printing operation, a burnt deposit occurs in the nozzle groups GB1'_1 to GB1'_6 in accordance with the duties of the nozzles. Particularly in the nozzle groups GB1'_2 to GB1'_5 having high duties, the burnt deposit degree increases. Meanwhile, since the nozzles in the white area other than the nozzle groups GB1'_1 to GB1'_6 are not used for the printing operation, the burnt deposit attachment amount does not change before and after the printing operation.

(Third Single-Path Printing Operation (Third Printing Mode))

Figure 7A:
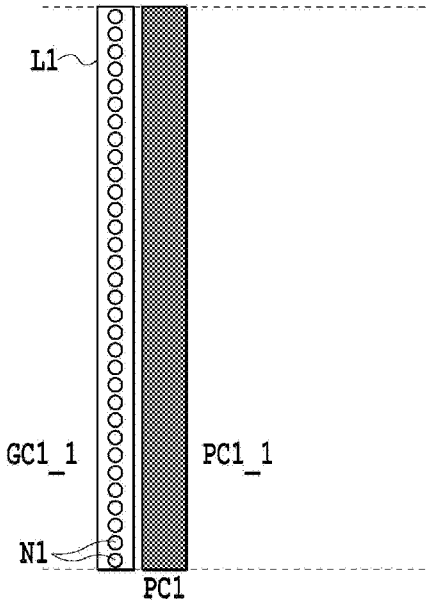
FIGS. 7A and 7B are schematic diagrams illustrating a relation between a nozzle array and a mask pattern of a print head used to describe a single-path printing operation as a third printing mode of the embodiment.
Figure 7B:
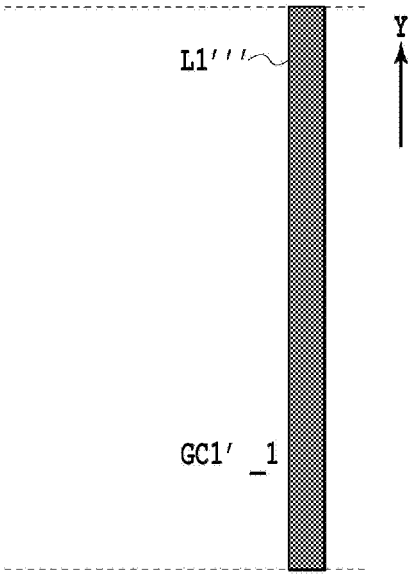

FIGS. 7A and 7B are schematic diagrams illustrating a relation between the mask pattern and the nozzle array of the print head used for describing a single-path printing operation as the third printing mode of the embodiment. FIG. 7A illustrates the nozzle array of the color ink and the mask pattern corresponding thereto and FIG. 7B illustrates the attachment state of the burnt deposit which is supposed to occur in the nozzle of the color ink after the printing operation. In the third printing mode, the nozzle array of the clear ink is not used.

As illustrated in FIG. 7A, printing an image on the printing area is completed by a one-time printing operation in the third printing mode and thus the duty of the mask pattern is the same in all nozzles. That is, all nozzles are used in the same way. As a result, it is estimated that the burnt deposit is uniformly attached in the burnt deposit state illustrated in FIG. 7B.

Figure 8:
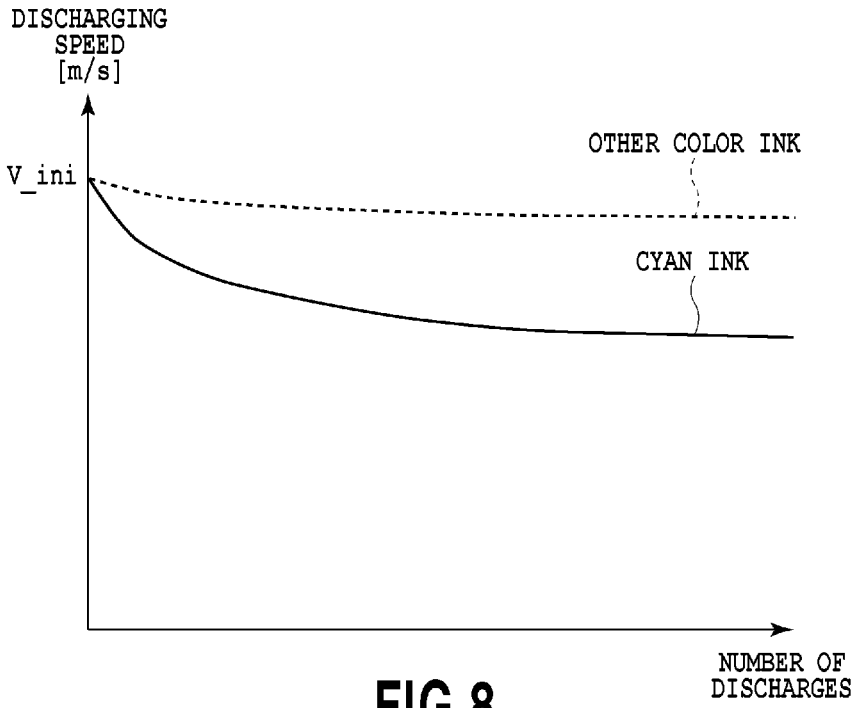
FIG. 8 is a diagram illustrating the influence of a burnt deposit in response to the type of ink.

FIG. 8 is a diagram illustrating the influence of the burnt deposit in response to the type of ink. In the figure, the horizontal axis indicates the number of times of discharging the ink from the nozzle (hereinafter, referred to as the "number of discharges") and the number of discharges increases as it goes toward the right side. The vertical axis indicates the discharging speed of the ink droplet discharged from the nozzle and the speed increases as it goes toward the upside. As illustrated in the figure, a change in speed caused by the influence of the burnt deposit is different in accordance with the type of ink. In the example illustrated in the figure, in the case of the cyan ink, a speed decreases due to the influence of the burnt deposit as the number of discharges increases as indicated by the solid line. Due to a change in speed, the printed image may have a change in density due to the relation with, for example, different types of ink. On the other hand, as indicated by the dashed line, in the case of the other color ink, a change in speed in accordance with an increase in the number of discharges is small and the influence with respect to the above-described change in density is small. In the embodiment, a preliminary discharge control is performed as below by using cyan as a specific color.

When there is a factor causing a change in density as described above, a printing operation is performed by the nozzle having an occurrence factor which may cause a change in density in the first printing mode if the single-path printing operation as the third printing mode is performed after the first multi-path printing operation as the first printing mode. As a result, there is a case where the printed image may be uneven. Also when the single-path printing operation of the third printing mode is performed after the second multi-path printing operation as the second printing mode, there is a case where a change in density may occur similarly although the state is different from that of the first printing mode. For this reason, in the embodiment, preliminary discharge of the cyan ink is performed in accordance with the previous printing mode.

(Preliminary Discharge Control)

Figure 9:
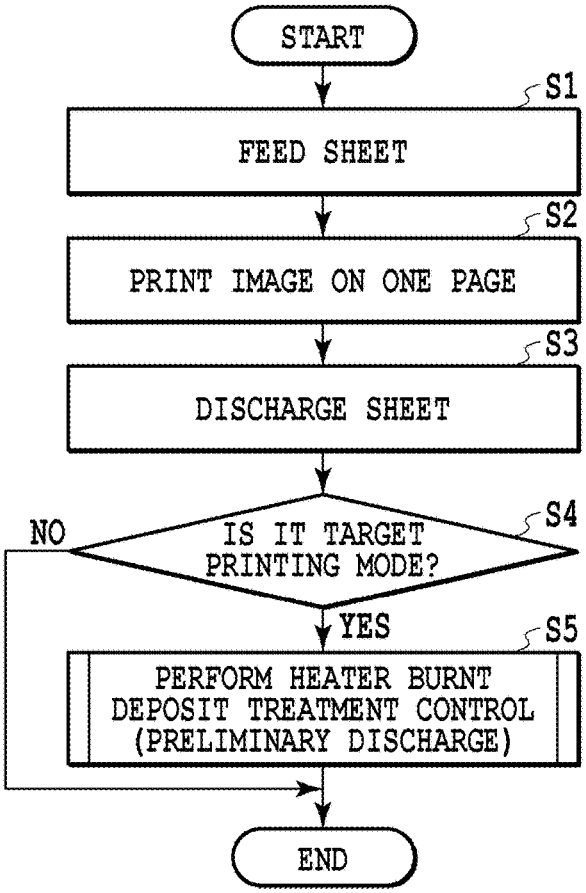
FIG. 9 is a flowchart illustrating a process of controlling preliminary discharge in response to a printing mode, that is, a printing operation according to the embodiment of the invention.

FIG. 9 is a flowchart particularly illustrating a process of controlling the preliminary discharge in accordance with the printing mode in the printing operation according to the embodiment of the invention. When the printing apparatus receives printing data, a printing sheet is fed in step S1, an image is printed on one page in step S2, and the printing sheet is discharged in step S3. Then, in step S4, the printing mode is determined based on the header information of the printing data having been used for the printing operation. More specifically, any one of the first to third printing modes is determined. In the case that the first printing mode or the second printing mode has been performed, that is, the printing mode which has non-used nozzles has been performed, preliminary discharge for the aging process in step S5 is performed. On the other hand, in the case of the single-path printing operation as the third printing mode, the preliminary discharge is not performed and the main process is ended.

Figure 10:
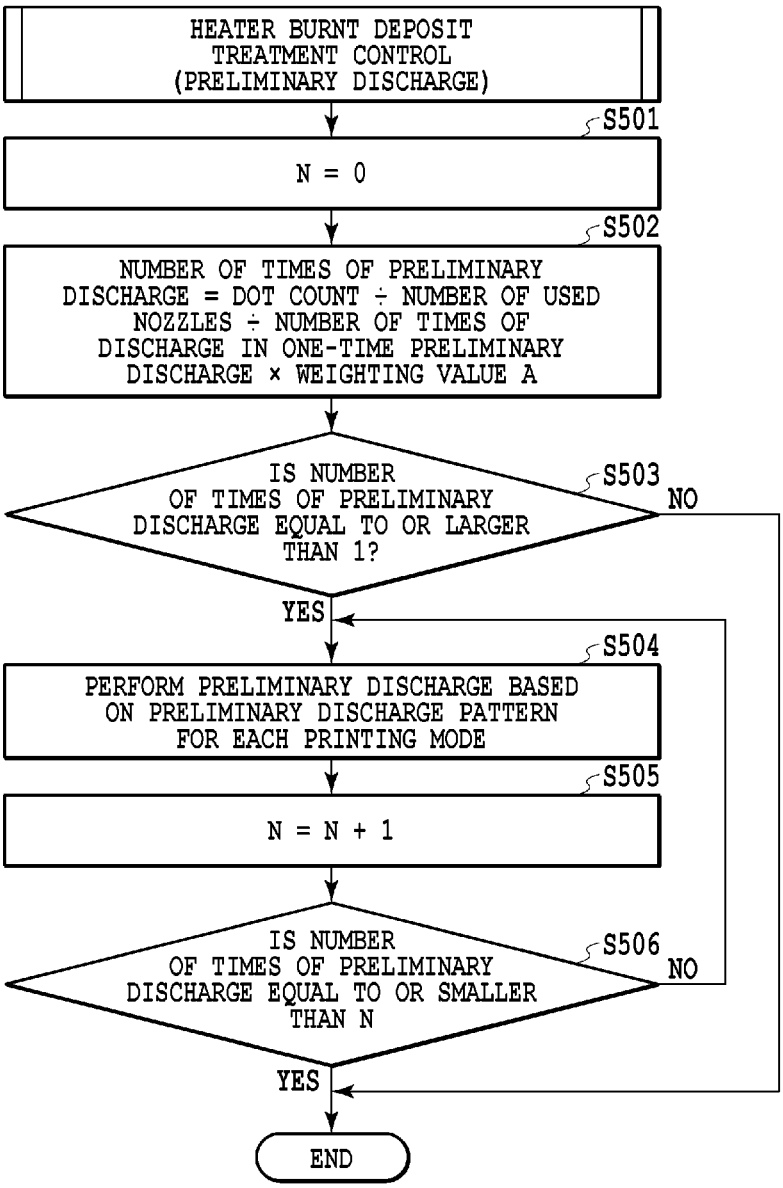
FIG. 10 is a flowchart specifically illustrating a process of step S5 illustrated in FIG. 9.

FIG. 10 is a flowchart illustrating the detail of step S5 illustrated in FIG. 9. First, in step S501, the initial value of the parameter N for counting the number of times of the preliminary discharge is set to zero. The counted value N is used for performing the preliminary discharge for every predetermined unit involved with the number of discharge (the number of discharges), as will be described below. Next, in step S502, the number of times of the preliminary discharge of the non-used nozzle is calculated. More specifically, the number of times of the discharge (the number of discharges) corresponding to the dot counted value for each ink used in one page in step S2 of FIG. 9 and stored in a predetermined memory is used. In the embodiment, the dot counted value of the cyan ink for each page is read. Then, the dot counted value is divided by the number of the nozzles used in the nozzle array of the cyan (see FIGS. 5A to 5C and FIGS. 6A to 6C). In this way, when the dot counted value is divided by the number of the used nozzles, the number of discharges of each nozzle used for the multi-path printing operation can be obtained. The dot counted value is further divided by the number of times of the discharge (the number of discharges) in the one-time (each) preliminary discharge. That is, in the embodiment, since the preliminary discharge is performed by repeating the preliminary discharge pattern which is prepared in advance and in which the number of times of the discharge is set, the number of times of the preliminary discharge is calculated by dividing the dot counted value by the number of discharges of each preliminary discharge. Finally, a weighted value A is given thereto. The weighted value A is an adjustment value used from the viewpoint of the gradation mask and suppressing the unevenness of density. When the gradation mask is used, the peak of the gradation mask is not considered, in that the average value of the above-obtained number of times of the preliminary discharge for each nozzle is used. For that reason, the weighted value is set in consideration of the nozzle of which the duty of the gradation mask is highest. For example, when the duty y of the peak for the average duty of the gradation mask is 1.5 times, the weighted value is set to 1.5.Further, from the viewpoint of suppressing a change in density between the used nozzle and the non-used nozzle, the peak of the gradation mask is not used. Instead, in order to reduce the discharge time and the discharge amount of the non-used nozzle, the minimum number of times of preliminary discharge for suppressing a change in density is set. For example, when a change in density of the non-used nozzle can be suppressed by using 0.5 times preliminary discharge with respect to the peak of the gradation mask, the weighted value is set to 0.5. From the above-described two viewpoints, a relation of weighted value A =1.5 ×0.5 =0.75 is determined.

Next, in step S503, it is determined whether the calculated number of times of preliminary discharge is one or more. When the number is smaller than one, the preliminary discharge is not performed and the main process is ended. When the number of times of the preliminary discharge is one or more, the preliminary discharge for each printing mode is performed in step S504.

Figure 11A:
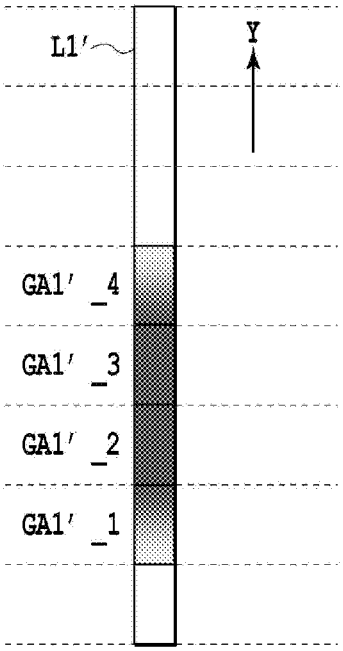
FIGS. 11A and 11B are diagrams illustrating a preliminary discharge pattern corresponding to the first printing mode.
Figure 11B:
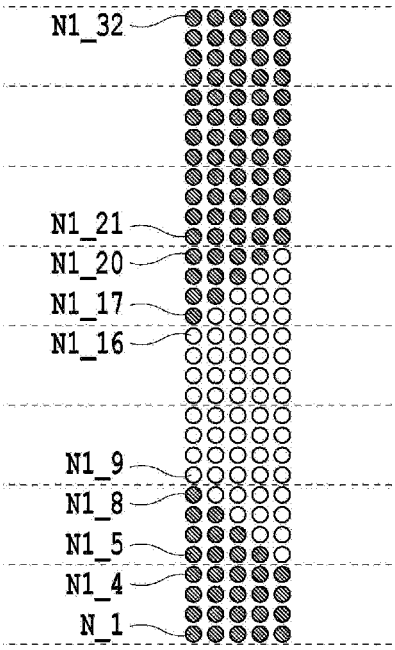
Figure 12A:
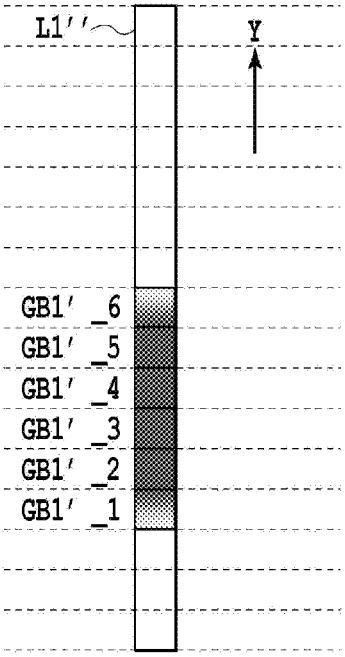
FIGS. 12A and 12B are diagrams illustrating a preliminary discharge pattern corresponding to the second printing mode.
Figure 12B:
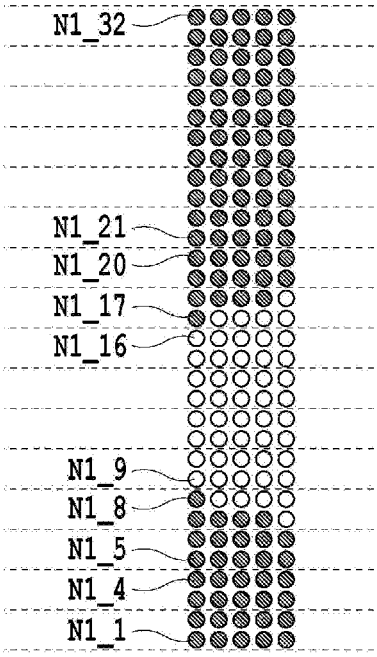

FIGS. 11A and 11B are diagrams illustrating a preliminary discharge pattern corresponding to the first printing mode and FIGS. 12A and 12B are diagrams illustrating a preliminary discharge pattern corresponding to the second printing mode.

FIG. 11A illustrates the burnt deposit state of the color ink after the printing operation illustrated in FIG. 5C, and FIG. 11B illustrates the preliminary discharge pattern corresponding to the multi-path printing operation of the first printing mode. In FIG. 11B, the vertical direction indicates the position of the nozzle and the horizontal direction corresponds to a unit of the number of discharges in each preliminary discharge. In FIG. 11B, the black color indicates the discharge state and the white color indicates the non-discharge state. Further, in order to simplify the drawings, the number of discharges is set to five times, but the number of discharges is not, of course, limited thereto. As illustrated in the same figure, a maximum of five ink droplets are discharged during the one-time preliminary discharge. Specifically, in the first printing mode, the nozzles N1_1 to N1_4 and N1$_{_21\ to\ N1}$_32 as the non-used nozzles at the end portion perform the discharge by the maximum number of discharges and the nozzles N1_9 to N1_16 as the used nozzles do not perform the discharge. Further, the nozzles N1_5 to N1_8 and N1_17 to N1_20 are used to discharge the ink by the number of discharges corresponding to the duty of the used gradation mask. By the above-described configuration, the preliminary discharge is performed by the number of discharges corresponding to the gradation mask of the printing mode. The preliminary discharge corresponding to the second printing mode illustrated in FIGS. 12A and 12B can be also described in this way.

Referring to FIG. 10 again, in step S505, the counted value N is increased so that the number of times of the preliminary discharge which has been performed is calculated. Then, in step S506, it is determined whether the number N of times of preliminary discharge reaches the number of times of the preliminary discharge calculated in step S502. The process after step S504 is repeated until the number N of times of preliminary discharge reaches the calculated value.

As described above, it is determined whether to perform the preliminary discharge in accordance with the printing mode that has been then performed. When the preliminary discharge is performed, the preliminary discharge pattern corresponding to the performed printing mode is used. Thereby, it is possible to simplify the process. Also, since the ink is appropriately discharged from the non-used nozzle in each printing mode, it is possible to suppress a change in density caused by the burnt deposit of the used and non-used nozzles. That is, since a change in density caused by the burnt deposit of the used and non-used nozzles is suppressed after the preliminary discharge ends, it is possible to appropriately reduce a change in density when the single-path printing operation of using all nozzles is performed as in the third printing mode.

(Recovery Operation Before Preliminary Discharge Operation)

Figure 13:
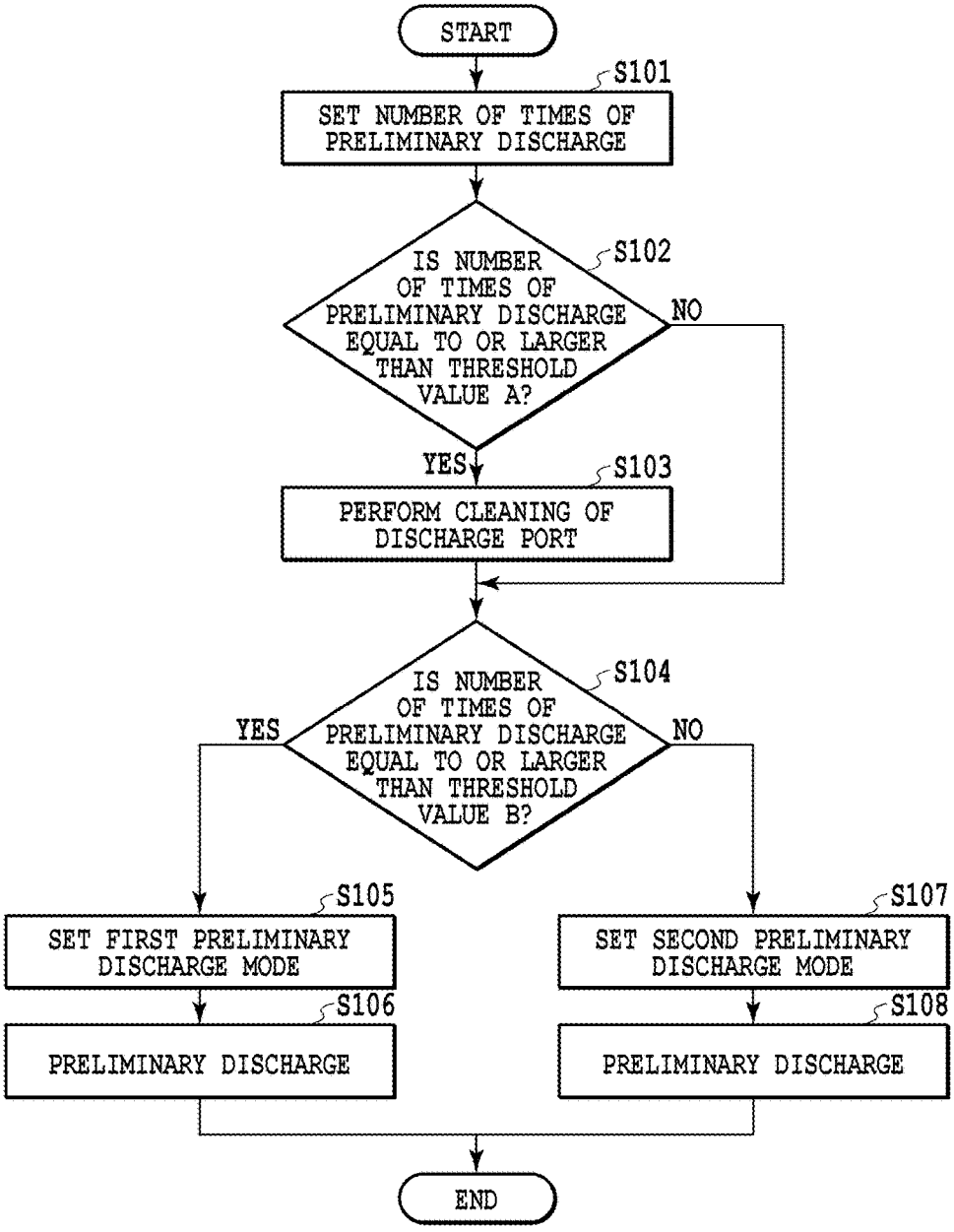
FIG. 13 is a flowchart illustrating a recovery operation according to the embodiment of the invention.

FIG. 13 is a flowchart illustrating the recovery operation according to the embodiment of the present invention. Here, this process is performed before preliminary discharge such as the above described preliminary discharge. As an example, in step S5 of FIG. 9, this process is a part of the process of FIG. 10 or a process performed before the process of FIG. 10.

When the process is started, the necessary number of times of preliminary discharge is first set in step S101. The necessary number of times of preliminary discharge is set based on the printing amount of the printing operation performed before the present process is started. Specifically, when the present process is performed as the preliminary discharge of step S5, the present process is performed as the processes of step S501 to step S502 in FIG. 10. In this case, the process after step S102 to be described below is performed, while the process of step S503 is not performed immediately after the process of step S502. In addition, the process of step S101 performed in the case of the preliminary discharge, other than the preliminary discharge of FIGS. 5A to 5C, is similar to that of step S502.

After the process of step S101, in step S102, it is determined whether to perform a wiping operation (a cleaning operation) before the preliminary discharge based on the number of times of the preliminary discharge set in step S101 (a wiping determination step). In this determination, the threshold value A is used. That is, when the set number of times of preliminary discharge is equal to or larger than the threshold value, the wiping operation is performed in step S103. Thereby, as described above in FIG. 2, the ink attached to the nozzle arrangement surface of the print head 5 is removed by the wipers 32A, 32B, and 32C so that the ink is scraped from the nozzle arrangement surface. Although not illustrated in the drawings, when the nozzle arrangement surface is cleaned by the wiping mechanism 32, the attached ink may be pushed into the nozzle. However, the ink is discharged by the subsequent preliminary discharge.

The threshold value A used in this step is one thousand nine hundred sixty-nine times in the embodiment as illustrated in FIG. 14A. When the preliminary discharge is performed for a comparatively long time by the number of times equal to or larger than the number of times of the preliminary discharge set in step S101, the wiping operation is performed. That is, when the time for the preliminary discharge is comparatively longer than the threshold value A, the wiping operation is performed in advance. Accordingly, it is possible to reduce the influence of the nozzle that does not perform the preliminary discharge due to the mist attached thereto. Meanwhile, since the wiping operation is not performed when the number of times of the preliminary discharge is smaller than the threshold value, that is, the time for the preliminary discharge is not so long, it is possible to suppress decrease in throughput caused by the wiping operation.

In step S102, when it is determined that the discharge port does not need to be cleaned and the current step is step S104 after step S103, it is determined whether the preliminary discharge mode involved with the capping operation is the first preliminary discharge mode or the second preliminary discharge mode (a capping determination step). In this determination, it is determined whether the number of times of the preliminary discharge set in step S101 is equal to or larger than the threshold value B.

When the number of times of the preliminary discharge is equal to or larger than the threshold value B, in step S105, the first preliminary discharge mode is set so that the preliminary discharge is performed while the print head 5 is capped. Then, in step S106, the preliminary discharge is performed while the print head is capped. The preliminary discharge can be set as, for example, the preliminary discharge described in step S504 of FIG. 10. Meanwhile, when the number of times of the preliminary discharge is smaller than the threshold value B, in step S107, the second preliminary discharge mode is set so that the preliminary discharge is performed while the print head is not capped. Then, in step S108, the preliminary discharge is performed with respect to the ink receiving box 31 (FIG. 1) while the print head is not capped. The preliminary discharge can be also set as, for example, the preliminary discharge described in step S504 of FIG. 10. FIG. 14B illustrates the discharge conditions of the first/second preliminary discharge.

As the threshold value B used in step S104, the threshold value is thirty-three times in the embodiment as illustrated in FIG. 14A. That is, the threshold value is set so that the preliminary discharge time does not reach the time in which the mist generated in the preliminary discharge does not influence the other parts of the apparatus. Accordingly, since the capping operation is omitted in the preliminary discharge, which is supposed to have a small influence of the mist, degradation in throughput can be suppressed.

According to the above-described embodiment, it is possible to suppress degradation in throughput while suppressing a discharge error and a mist generation amount even when the number of times of the preliminary discharge increases.

Other Embodiments

In the above-described embodiment, the preliminary discharge has been described which is used for the aging process of solving a difference in density among the nozzles caused by the burnt deposit, but the application of the invention is not limited thereto. As apparent from above, the invention can be also applied to the preliminary discharge which is performed to discharge the ink thickened inside the nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107490 filed May 27, 2015 , which is hereby incorporated by reference herein in its entirety.

What is claimed is:

1. An inkjet printing apparatus comprising:

a print head having a nozzle arrangement surface on which a nozzle for discharging ink is provided, the print head configured to perform a preliminary discharge operation;

a cap unit configured to cover the nozzle arrangement surface;

a setting unit configured to set a preliminary discharge amount based on a printing amount of a printing operation performed by the print head; and a control unit configured to cause the print head to perform the preliminary discharge operation in a state where the cap unit covers the nozzle arrangement surface if the preliminary discharge amount set by the setting unit is greater than a first threshold value and cause the print head to perform the preliminary discharge operation in a state where the cap unit does not cover the nozzle arrangement surface if the preliminary discharge amount set by the setting unit is less than the first threshold value.

2. The inkjet printing apparatus according to claim 1, wherein the print head having a first nozzle array for discharging a first ink and a second nozzle array for discharging a second ink which is different from the first ink on the nozzle arrangement arrays, and the print head performs the preliminary discharge operation by the first nozzle array.

3. The inkjet printing apparatus according to claim 2, further comprising a wiping unit configured to perform a wiping operation on the second nozzle array, wherein a control unit configured to cause the wiping unit to perform the wiping operation before the preliminary discharge operation, and the control unit causes the wiping unit to perform the wiping operation if the preliminary discharge amount is greater than a second threshold value, and causes the wiping unit not to perform the wiping operation if the preliminary discharge amount is less than the second threshold value.

4. The inkjet printing apparatus according to claim 2, wherein the discharging speed of the first ink tends to be lower than that of the second ink according to the number of times of discharge.

5. The inkjet printing apparatus according to claim 4, wherein the first ink is cyan ink.

6. The inkjet printing apparatus according to claim 1, wherein the preliminary discharge amount is represented by a number of times of preliminary discharge.

7. The inkjet printing apparatus according to claim 1, wherein the preliminary discharge amount is represented by a number of times of preliminary discharge and the control unit causes the print head to perform the preliminary discharge operation in a state where the cap unit covers the nozzle arrangement surface if the number of times of the preliminary discharge is greater than the first threshold value, and causes the print head to perform the preliminary discharge operation in a state where the cap unit does not cover the nozzle arrangement surface if the number of times of the preliminary discharge is less than the first threshold value.

8. The inkjet printing apparatus according to claim 1, further comprising a print mode performing unit configured to perform any one of a plurality of print modes, wherein the control unit causes the print head to perform the preliminary discharge operation in which the ink is discharged in a preliminary discharge pattern according to the print mode performed.

9. An inkjet printing apparatus comprising:

a print head having a first nozzle array for discharging a first ink and a second nozzle array for discharging a second ink whose discharging speed tends to be lower than that of the first ink according to the number of times of discharge, the print head configured to perform a preliminary discharge operation by the second nozzle array;

a wiping unit configured to perform a wiping operation on the first nozzle array; and a control unit configured to cause the print head to perform the preliminary discharge operation and to cause the wiping unit to perform the wiping operation before the preliminary discharge operation, wherein the control unit causes the wiping unit to perform the wiping operation if a preliminary discharge amount in the preliminary discharge operation is greater than a first threshold value, and causes the wiping unit not to perform the wiping operation if the preliminary discharge amount is less than the first threshold value.

10. The inkjet printing apparatus according to claim 9, wherein the second ink is cyan ink.

11. A control method for an inkjet printing apparatus including a print head having a nozzle arrangement surface on which a nozzle for discharging ink is provided, and a cap unit configured to cover the nozzle arrangement surface, the control method comprising:

a preliminary discharge step of performing a preliminary discharge operation by the print head, and a setting step of setting a preliminary discharge amount based on a printing amount of a printing operation performed by the print head, wherein, in the preliminary discharge step, the preliminary discharge operation is performed in a state where the cap unit covers the nozzle arrangement surface if the preliminary discharge amount set in the setting step is greater than a first threshold value and the preliminary discharge operation is performed in a state where the cap unit does not cover the nozzle arrangement surface if the preliminary discharge amount set in the setting step is less than the first threshold value.

12. The control method according to claim 11, wherein the print head has a first nozzle array for discharging a first ink and a second nozzle array for discharging a second ink which is different from the first ink on the nozzle arrangement arrays, and the preliminary discharge operation is performed by the first nozzle array.

13. The control method according to claim 12, wherein the inkjet printing apparatus includes a wiping unit configured to perform a wiping operation on the second nozzle array, the method further comprising:

wiping step of performing the wiping operation before the preliminary discharge operation if the preliminary discharge amount is greater than a second threshold value.

14. The control method according to claim 12, wherein the discharging speed of the first ink tends to be lower than that of the second ink according to the number of times of discharge.

15. The control method according to claim 14, wherein the first ink is cyan ink.

16. The control method according to claim 11, wherein the preliminary discharge amount is represented by a number of times of preliminary discharge.

17. The control method according to claim 11, wherein the preliminary discharge amount is represented by a number of times of preliminary discharge and the preliminary discharge operation is performed in a state where the cap unit covers the nozzle arrangement surface if the number of times of the preliminary discharge is greater than the first threshold value, and the preliminary discharge operation is performed in a state where the cap unit does not cover the nozzle arrangement surface if the number of times of the preliminary discharge is less than the first threshold value.

* * * * *